US006378827B1

(12) United States Patent
Kacines

(10) Patent No.: US 6,378,827 B1
(45) Date of Patent: Apr. 30, 2002

(54) CLIP FOR SECURING DECORATIVE ITEMS TO THE EDGES OF HOUSEHOLD SURFACES

(76) Inventor: Jeffrey J. Kacines, P.O. Box 1594, Allen, TX (US) 75013

( * ) Notice: Subject to any disclaimer, the term of this patent is extended or adjusted under 35 U.S.C. 154(b) by 0 days.

(21) Appl. No.: 09/400,495

(22) Filed: Sep. 21, 1999

(51) Int. Cl.[7] ..... A47F 5/00

(52) U.S. Cl. ..... 248/231.81; 248/301; 24/546; 24/555; 24/563

(58) Field of Search ..... 24/546, 555, 563; D8/371; 248/231.81, 215, 301, 339, 316.7, 914, 231.31

(56) References Cited

U.S. PATENT DOCUMENTS

| | | | | | |
|---|---|---|---|---|---|
| 932,778 | A | | 8/1909 | Gould | 248/304 |
| 1,496,388 | A | * | 6/1924 | Stern | 248/231.81 |
| 1,726,316 | A | * | 8/1929 | Saxton | 248/215 |
| 1,856,847 | A | | 5/1932 | Gates | 248/231.81 |
| 2,431,752 | A | * | 12/1947 | Hilstrom | 248/310 |
| 2,461,071 | A | | 2/1949 | Mettenleiter | 248/227 |
| 2,565,719 | A | * | 8/1951 | Church | 248/215 |
| 3,376,006 | A | * | 4/1968 | Zezula | 248/339 |
| D223,640 | S | * | 5/1972 | Kemp | D19/65 |
| 3,710,391 | A | * | 1/1973 | McGlynn | 2/460 |
| 3,772,742 | A | | 11/1973 | Gigante | 24/84 B |
| D255,774 | S | * | 7/1980 | Soucy | D8/371 |
| 4,709,891 | A | | 12/1987 | Barnett | 248/214 |
| 4,887,785 | A | * | 12/1989 | Blaich | 248/339 |
| 4,903,929 | A | | 2/1990 | Hoffman | 248/229 |
| D312,773 | S | * | 12/1990 | Salinas | D16/336 |
| 5,082,225 | A | | 1/1992 | Nespoli | 248/231.8 |
| 5,329,728 | A | * | 7/1994 | Ray | 248/318 |
| 5,388,284 | A | * | 2/1995 | Garnett | 24/563 |
| D357,402 | S | | 4/1995 | Roethler | D8/370 |
| D360,572 | S | | 7/1995 | Adams | D8/367 |
| 5,489,078 | A | | 2/1996 | Risley | 248/231.81 |
| 5,491,878 | A | * | 2/1996 | Janouschek | 24/3.3 |
| D376,387 | S | | 12/1996 | Saccoccio | D19/65 |
| 5,642,819 | A | | 7/1997 | Ronia | 211/86.01 |
| 5,855,046 | A | * | 1/1999 | Dymott et al. | 24/507 |
| 5,934,525 | A | * | 8/1999 | Blanchard | 223/96 |
| 6,182,933 | B1 | * | 2/2001 | Rapp | 248/231.81 |

FOREIGN PATENT DOCUMENTS

| | | | | |
|---|---|---|---|---|
| GB | 9940 | * | 4/1913 | 248/231.81 |

* cited by examiner

*Primary Examiner*—Anita King
*Assistant Examiner*—Jon Szumny
(74) *Attorney, Agent, or Firm*—Baker Botts L.L.P.

(57) ABSTRACT

A support unit for supporting articles hung from a generally planar surface is provided that includes a support arm for placement on a top surface of a generally planar surface. The support arm contacts the top surface of the generally planar surface. A mating portion contacts a bottom surface of the general planar surface opposite the top surface of the generally planar surface contacted by the support arm. A curved portion connects the support arm to the mating portion. The curved portion provides the gripping force between the support arm and the mating portion. A hook extends downwardly from the mating portion and towards the curved portion. The hook supports articles hung therefrom.

22 Claims, 1 Drawing Sheet

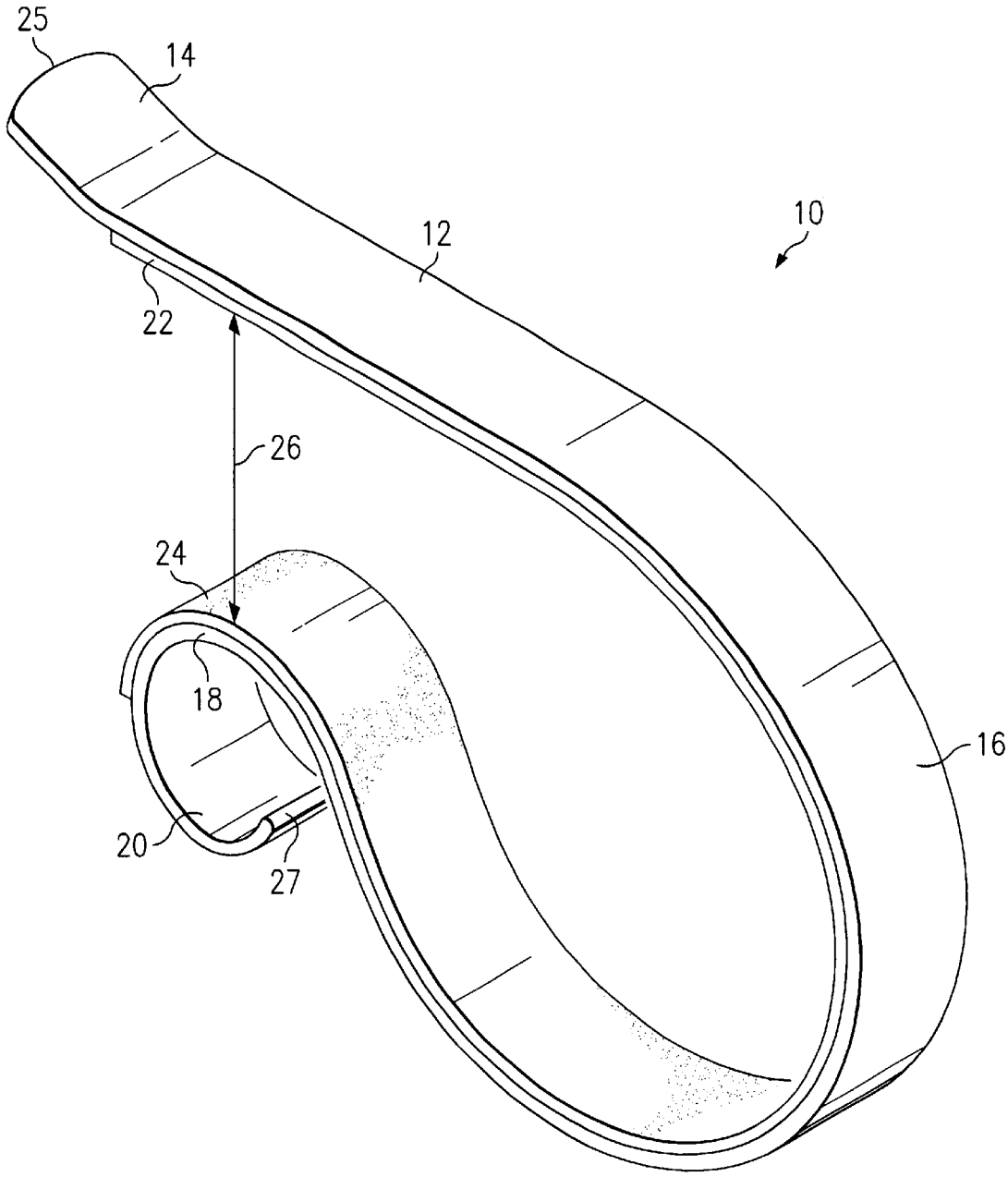
25
14
10
12
22
26
24
18
16
20
27

CLIP FOR SECURING DECORATIVE ITEMS TO THE EDGES OF HOUSEHOLD SURFACES

TECHNICAL FIELD OF THE INVENTION

This invention relates in general to the field of clips and more particularly to a clip for securing decorative items to the edges of household surfaces.

BACKGROUND OF THE INVENTION

Many people hang decorative accessories from fireplace mantels, shelves, counters, window sills and other household surfaces. Among these decorative accessories are Christmas stockings, Christmas lights, and other decorative items such as garland. The two primary options available to hang decorative accessories from household surfaces are nails and weighted hangers. Although nails are a cost effective method of attaching decorative accessories to household surfaces, the use of nails tends to damage household surfaces and cannot be used with brick, marble, granite, or other hard surfaces. Weighted hangers are primarily weighted figurines that rest on the top of a household surface and have a hanger on which Christmas stockings and the like are hung. Weighted figurines have limited weight holding capability. In addition, weighted figures can slip and slide thereby causing damage to the household surface. These weighted figures can also fall from household surfaces and potentially cause injury to persons below or damage to floors or furniture.

Most of the currently available stocking holders are designed for a single purpose, hanging Christmas stockings. Stringing lights, garland or other decorations between stocking holders is not a realistic option for two reasons. First, the hooks are often too small or too awkward to use for anything other than hanging stockings. In addition, the vast majority of these products cannot support the weight of lights or garland. Even the heaviest products tend to slide out of place when items are strung from adjacent stocking holders since they frequently slide on the household surface. Therefore, it is desirable to provide improved device for securing decorative accessories and other items to the edges of household surfaces.

SUMMARY OF THE INVENTION

From the foregoing, it may be appreciated that a need has arisen for a clip for securing decorative items to the edges of household surfaces that provides improved holding capacity, adaptability, and safety.

In accordance with the present invention, a support unit for supporting articles hung from a generally planar surface is provided that substantially eliminates and reduces disadvantages and problems associated with conventional devices for hanging decorative items from the edges of household surfaces. According to an embodiment of the present invention, a support unit for supporting articles hung from a generally planar surface is provided that includes a support arm for placement on a top surface of a generally planar surface. The support arm contacts the top surface of the generally planar surface. A mating portion contacts a bottom surface of the generally planar surface that is opposite the top surface of the generally planar surface contacted by the support arm. A curved portion connects the support arm and to the mating portion and provides gripping force between the support arm and the mating portion. A hook extends downwardly from the mating portion and towards the curved portion. The hook supports articles hung from the hook.

The present invention provides various advantages over conventional devices for hanging decorative items from household surfaces. For example, one advantage is an increased holding capacity for the device. Another advantage is that the device does not damage surfaces and can be used on a variety of surface sizes and shapes. Yet another advantage is increased safety due to enhanced gripping power and reduced weight.

BRIEF DESCRIPTION OF THE DRAWINGS

For a more complete understanding of the present invention and the advantages thereof, reference is now made to the following description taken in conjunction with the accompanying drawing and wherein:

FIG. 1 illustrates a clip for securing decorative items to the edges of household surfaces.

DETAILED DESCRIPTION OF THE DRAWINGS

Referring to FIG. 1, a clip for securing decorative items to the edges of household surfaces is generally indicated at 10. Clip 10 may be formed from a continuous strip of pliable material that will not fracture when clip 10 is opened or closed to be placed on household surfaces of varying dimension. In an embodiment, clip 10 is formed from a thin, pliable metal such as cold rolled steel. However, any suitable material may be used such as hot rolled steel, aluminum, metal alloys, brass, and various plastics. The material comprising clip 10 is chosen such that it is deformable while retaining an inherent strength of the material.

The household surface to which clip 10 attaches may be a fireplace mantle, counter, shelf, window sill, or any other generally horizontal surface. Clip 10 provides sufficient gripping power to accommodate surfaces that may be slanted in one direction. In addition, household surfaces that do not have a parallel top surface and bottom surface may be accommodated. An example of this type of surface is a mantle where the bottom surface is curved rather than flat. These household surfaces may be referred to as generally planar surfaces.

Clip 10 includes a support arm 12 for resting on the top surface of the household surface. Support arm 12 extends sufficient length to counterbalance articles hung from a hook 20 formed on clip 10. Support arm 12 terminates in a lip 14 for ease of attaching clip 10 to the household surface. Extending from the end of support arm 12 opposite lip 14 is a curved portion 16 that curves downward and then upward towards a bottom surface of support arm 12. A mating portion 18 is formed at the end of curved portion 16. Mating portion 18 contacts the bottom surface of the household surface in a gripping manner. Extending from mating portion 18 is a hook 20 formed by curving mating portion 18 downward and then upward toward a bottom surface of mating portion 18.

A first protective layer 22 is laminated to the bottom surface of support arm 12. A second protective layer 24 is laminated to the top surface of mating portion 18. In another embodiment, first protective layer 22 and second protective layer 24 are formed from a continuous piece of material. First protective layer 22 and second protective layer 24 may be any material that provides a cushion between both the bottom surface of support arm 12 and the top surface of mating portion 18 where they contact the household surface. In addition, first protective layer 22 and second protective layer 24 enhance the gripping action of support arm 12 and mating portion 18. In one embodiment, the material comprising first protective layer 22 and second protective layer 24 is polyurethane. However, any suitable material may be used such as various plastics, rubber, silicon rubber, and other rubber-like materials. It will be understood that clip 10 may function either with or without first protective layer 22 or second protective layer 24. First protective layer 22 and second protective layer 24 may be adhered to support arm 12 and mating portion 18, respectively, by applying an adhesive. In one embodiment, first protective layer 22 and second protective layer 24 are self-adhesive strips of material.

Support arm 12 is typically one millimeter to 3 millimeters thick and is roughly thirteen millimeters wide. This width at support arm 12 provides stability and surface area for gripping the household surface. The width of the material comprising clip 10 in areas other than at support arm 12 can vary as desired for aesthetic appeal. Dimensions are given in this specification for purposes of illustration and do not limit the invention to any particular set of dimensions. In one embodiment, the width of the material comprising clip 10 is constant with rounded ends 25 and 27 at ends of lip 14 and hook 20. The rounded ends eliminate sharp edges that could cause personal injury.

Support arm 12 terminates at lip 14. Lip 14 is positioned past mating portion 18 to ensure adequate contact between first protective layer 22 and the household surface gripped at an opening 26.

In the opposite direction, support arm 12 extends to curved portion 16 which forms a circular arc with a radius approximately equal to the size of opening 26. This radius allows opening 26 to be doubled or halved to fit onto a mating surface without excessive stress on the material comprising clip 10. The inside edge of curved portion 16 can be used to support decorations between the clip 10 and the household surface. Although the arc of curved portion 16 does not need to be circular, corners are avoided in curved portion 16 since they are potential stress concentrators where fractures could occur while adjusting opening 26.

Curved portion 16 continues to mating portion 18. Mating portion 18 provides a surface for contacting the bottom surface of the household surface. Mating portion 18 continues to hook 20 which forms an arc used to hang decorative items such as Christmas stockings, garland, and lights. Mating portion 18 is curved thereby allowing clip 10 to maintain an adequate grip over a range of mating surface sizes and shapes.

To attach clip 10 to a household surface, clip 10 is grasped at lip 14 and hook 20. These points are then pulled apart to increase opening 26 to approximately match the thickness of the household surface. If the thickness of the household surface is less than opening 26, then lip 14 and hook 20 are pushed together so that opening 26 decreases to approximately match the thickness of the household surface. The separation formed by opening 26 should be slightly less than the thickness of the household surface since this will improve the grip of clip 10 when it is put in place. Once the separation of 10 opening 26 approximately matches the thickness of the household surface, clip 10 is slipped onto the household surface. The household surface should now be gripped by clip 10 at opening 26 by the bottom surface of support arm 12 and the top surface of mating portion 18.

With clip 10 now attached to the household surface, decorations can be hung from hook 20 or from the space formed between curved portion 16 and the household surface. In addition, decorations may be attached to hook 20 or curved portion 16 using adhesive, wire, string, or similar means of attachment. If more than one clip 10 is attached to the household surface, then decorations such as lights, festoons, or garland can be strung from one clip 10 to another clip 10 by attaching or hanging the decorations from each hook 20 or each curved portion 16.

In some cases where the thickness of the household surface is much thinner than the separation at opening 26, mating portion 18 may not make contact with the bottom surface of the household surface. However, decorations may still be hung from hook 20 or curved portion 16 since the upper gripping point located at the underside of support arm 12 will still hold clip 10 in place.

To remove clip 10 from a household surface, clip 10 is grasped near lip 14 and hook 20 and pulled apart to increase the separation at opening 26. Clip 10 is then slid off of the household surface.

Thus, it is apparent that there has been provided in accordance with the present invention, a clip for securing decorative items to the edges of household surfaces that satisfies the advantages set forth above including increased holding capacity. Although the present invention and its advantages have been described in detail, it should be understood that various changes, substitutions, and alterations may be readily apparent to those skilled in the art and may be made herein without departing from the spirit and the scope of the present invention as defined by the following claims.

What is claimed is:

1. A support unit for supporting articles hung from a generally planar surface, comprising:

a substantially planar support arm operable to be placed on a top surface of a generally planar surface;

a mating portion formed into a curved arc operable to provide a single point of contact to a bottom surface of the generally planar surface opposite the top surface of the generally planar surface;

a curved portion extending directly from the support arm and connecting the support arm to the mating portion, the curved portion providing gripping force between the support arm and the mating portion, the curved portion forming a circular arc from the support arm to the single point of contact to the bottom surface provided by the mating portion; and a hook extending downwardly from the mating portion and towards the curved portion, the hook operable to support articles hung therefrom.

2. The support unit of claim 1, further comprising a lip extending from a terminal end of the support arm.

3. The support unit of claim 1, further comprising:

a first gripping pad coupled to a bottom surface of the support arm; and a second gripping pad coupled to a top surface of the mating portion.

4. The support unit of claim 3, wherein the first gripping pad and the second gripping pad are a continuous gripping pad.

5. The support unit of claim 3, wherein the first gripping pad and the second gripping pad are polyurethane.

6. The support unit of claim 3, wherein the first gripping pad and the second gripping pad are silicon rubber.

7. The support unit of claim 3, wherein the first gripping pad and the second gripping pad are plastic.

8. The support unit of claim 1, wherein the support arm, the curved portion, the mating portion, and the hook are formed from a continuous piece of material.

9. The support unit of claim 8, wherein the continuous piece of material includes steel.

10. The support unit of claim 8, wherein the continuous piece of material includes brass.

11. The support unit of claim 8, wherein the continuous piece of material includes plastic.

12. The support unit of claim 8, wherein the continuous piece of material is deformable while retaining an inherent strength of the material.

13. A one-piece clip for attaching articles to a generally planar surface having a top surface and a bottom surface, the clip made from a continuous strip of material having a first end and a second end, comprising:

a substantially planar support portion formed on the first end of the continuous strip of material, the support portion having a top surface and a bottom surface;

a mating portion formed near the second end of the continuous strip of material, the mating portion being a curved arc having a mating surface and a bottom surface;

a hook formed on the second end of the continuous strip of material, the hook operable to attach articles to the generally planar surface;

a first curve extending directly from the support portion to the mating portion, the first curve bending towards the bottom surface of the support portion, the first curve providing a gripping force for holding the bottom surface of the support portion in contact with the top surface of the generally planar surface and the mating surface of the mating portion in contact at a single point of the bottom surface of the generally planar surface, the first curve forming a circular arc from the support portion to the single point of contact with the bottom surface of the generally planar surface provided by the mating surface of the mating portion; and a second curve connecting the mating portion to the hook, the second curve bending away from the bottom surface of the support portion and towards the bottom surface of the mating portion, the second curve being outside of the circular arc formed by the first curve.

14. The clip of claim 13, further comprising a lip formed on the first end of the continuous strip of material.

15. The clip of claim 13, further comprising:

a first gripping pad coupled to the bottom surface of the support portion; and a second gripping pad coupled to the mating surface of the mating portion.

16. The clip of claim 15, wherein the first gripping pad and the second gripping pad are polyurethane.

17. The clip of claim 13, wherein the one-piece clip is formed from steel.

18. A device for securing articles to a generally planar surface, comprising:

a curvilinear body having a first end, a second end, a support portion, a curved portion, a mating portion, and a hook portion, the support portion extending straight outwardly along a substantially planar line from the first end, the curved portion extending directly from the support portion toward the mating portion, the mating portion being a curved arc providing a single point of contact to the generally planar surface, and forming a circular arc directly between the support portion and the single point of contact for securing the curvilinear body to the generally planar surface, the hook portion extending downwardly from the mating portion away from the curved portion and then upwardly toward the mating portion forming a hook at the second end for receiving articles to be hung from the generally planar surface.

19. The device of claim 18, further comprising a lip formed on the first end of the continuous strip of material.

20. The device of claim 18, further comprising:

a first gripping pad coupled to a bottom surface of the support portion; and a second gripping pad coupled to a top surface of the mating portion.

21. The device of claim 20, wherein the first gripping pad and the second gripping pad are polyurethane.

22. The device of claim 18, wherein the curvilinear body is formed from steel.

* * * * *